United States Patent [19]

Moreno

[11] 4,443,985

[45] Apr. 24, 1984

[54] COMPOSITE BUILDING CONSTRUCTION COMPRISING A COMBINATION OF PRECAST AND POURED-IN-PLACE CONCRETE

[76] Inventor: Jaime Moreno, 2074 Pratt Ave., Chicago, Ill. 60645

[21] Appl. No.: 297,983

[22] Filed: Aug. 31, 1981

[51] Int. Cl.[3] ..... E04B 1/00

[52] U.S. Cl. ..... 52/236.8; 52/252; 52/259

[58] Field of Search ..... 52/251, 252, 259, 250, 52/743, 744, 236.8

[56] References Cited

U.S. PATENT DOCUMENTS

| | | | |
|---|---|---|---|
| 4,060,948 | 12/1977 | Brownlee | 52/259 X |
| 4,081,935 | 4/1978 | Wise | 52/252 X |
| 4,147,009 | 4/1979 | Watry | 52/259 X |

FOREIGN PATENT DOCUMENTS

| | | | |
|---|---|---|---|
| 555219 | 5/1977 | U.S.S.R. | 52/259 |

*Primary Examiner*—Carl D. Friedman

*Attorney, Agent, or Firm*—Burmeister, York, Palmatier, Hamby & Jones

[57] ABSTRACT

Precast or poured columns are erected in a plurality of rows. Precast concrete beams are placed on temporary supports between the columns in each row. The beams are slightly shorter than the distance between the columns and are not supported by the columns. Precast concrete floor slabs are placed between the precast beams of adjacent rows, with the ends of the slabs partially overlapping the beams. Temporary forms are placed around the upper portions of the columns and under the end portions of the beams and the adjacent floor slabs. Concrete is then poured to form monolithic concrete members extending over the upper sides of the beams and filling the spaces between the ends of the slabs and also the spaces between the ends of the beams and the ends of the columns for uniting the beams, slabs and columns. After sufficient curing of the poured concrete, the forms and the temporary supports are removed. The columns support the composite beam structures comprising the monolithic concrete members and the precast beams, which support the precast floor slabs. Reinforcing members are preferably embedded in the monolithic concrete members. The method has the rapid erection advantage of a precast system, combined with many of the advantages of poured-in-place concrete, including rigidity and freedom from close tolerances.

2 Claims, 6 Drawing Figures

COMPOSITE BUILDING CONSTRUCTION COMPRISING A COMBINATION OF PRECAST AND POURED-IN-PLACE CONCRETE

FIELD OF THE INVENTION

This invention relates to methods of constructing buildings, and building constructions resulting from such methods.

BACKGROUND OF THE INVENTION

One known method of constructing buildings is to pour concrete in place, utilizing suitable forms, to produce poured-in-place concrete columns, beams and floor slabs. This method has the advantage of producing buildings which are strong, highly rigid, durable and highly fire resistant. However, this method requires the use of elaborate forms and temporary supports, which must be left in place for a sufficient time, often 28 days, to allow the concrete to cure until it develops adequate strength.

Another known method of constructing buildings is to assemble precast columns, beams and floor slabs. This method has the advantage of rapid erection, with little or no need for temporary supports. However, precast concrete buildings tend to be less rigid than poured-in-place concrete buildings. Moreover, the precast concrete components must be manufactured to close tolerances as to length and other dimensions, so that the precast components will fit together properly.

OBJECTS OF THE PRESENT INVENTION

One object of the present invention is to provide a building construction method which combines many of the advantages of both precast concrete and poured-in-place concrete.

A further object is to provide a new and improved building construction method which combines the rapid erection advantage of precast concrete construction, with the rigidity and integrity of poured-in-place concrete construction, as well as the advantage of freedom from close tolerances.

SUMMARY OF THE INVENTION

To achieve these and other objects, the present invention provides a method of building construction, comprising: providing a plurality of columns arranged in a plurality of rows, providing temporary support between the columns in each row, providing precast concrete beams having a length comparable to but less than the spacing distance between the columns in each row, placing the precast concrete beams on the temporary supports between the columns in each row with the ends of the beams short of the columns and not supported by the columns, placing precast concrete floor slabs to span between the precast concrete beams of adjacent rows with the end portions of the floor slabs partially overlapping the precast concrete beams, placing temporary forms around the upper portions of the columns and under the end portions of the precast concrete beams and the end portions of the adjacent precast concrete floor slabs, pouring concrete to form monolithic concrete members poured over the upper sides of the precast concrete beams and filling the spaces between the ends of the precast concrete floor slabs and also the spaces between the ends of the precast concrete beams and the ends of the columns for uniting the precast concrete beams, the precast concrete floor slabs and the columns, allowing the monolithic concrete members to cure to a suitable level of strength, and removing the forms and the temporary supports, the monolithic concrete members being supported upon the columns. The present invention resides not only in such method, but also in the resulting building construction.

The columns may be made of precast concrete, poured-in-place concrete, or any other suitable construction.

Reinforcing members may be embedded in the monolithic concrete members.

The columns may be made of concrete with reinforcing members projecting upwardly therefrom and embedded in the monolithic concrete members.

The precast concrete beams may be made with reinforcing members projecting therefrom and embedded in the monolithic concrete members.

The temporary supports are localized under the precast concrete beams, so that workers can proceed with the installation of electrical, plumbing and duct systems, even before the temporary supports are removed.

BRIEF DESCRIPTION OF THE DRAWINGS

Further objects, advantages and features of the present invention will appear from the following description, taken with the accompanying drawings, in which.

DETAILED DESCRIPTION OF THE ILLUSTRATIVE EMBODIMENT

Figure 1:
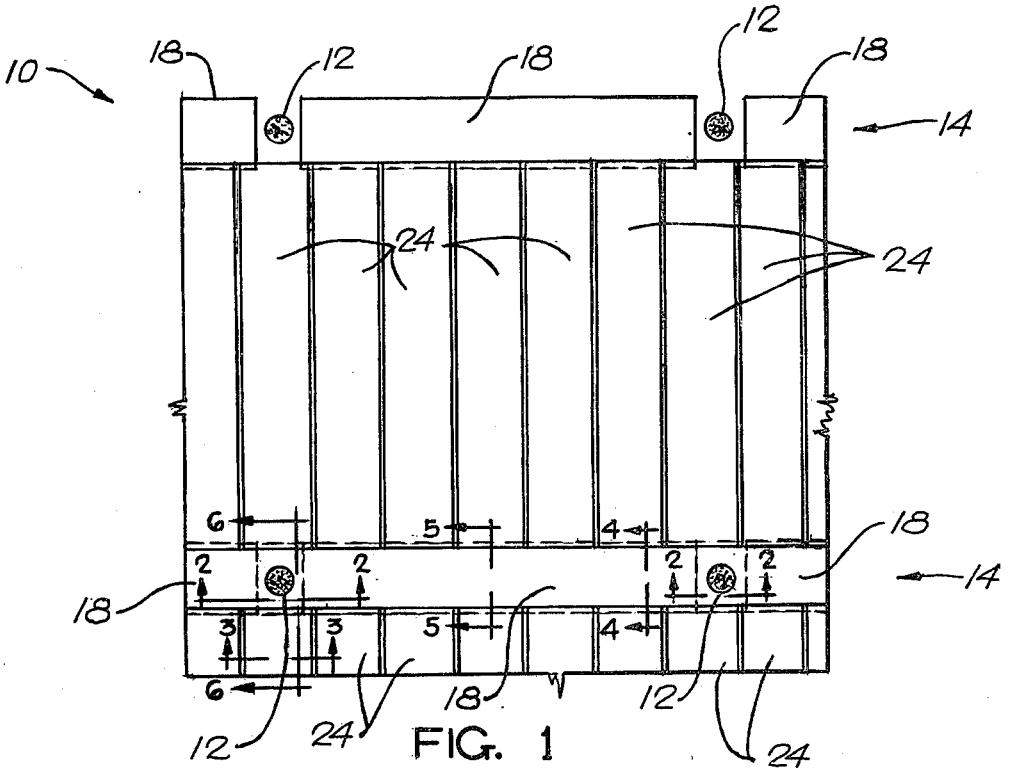
FIG. 1 is a fragmentary diagrammatic plan view showing an early stage of a building construction method, to be described as an illustrative embodiment of the present invention, the building construction being shown before the pouring of the concrete to form the monolithic concrete members.

As just indicated, the drawings illustrate an embodiment 10 of the building construction and method of the present invention. Such embodiment 10 comprises a composite building construction system utilizing both precast concrete components and poured-in-place concrete. The building construction system 10 is applicable to each of the floors of a building. The lowermost floor is built upon suitable footings or foundations. Each subsequent or upper floor is built upon the previous or underlying floor.

The building system 10 involves erecting or otherwise providing a plurality of columns 12, arranged in a plurality of parallel rows 14. The columns 12 are generally in a grid pattern. For the lowermost floor, the columns 12 are generally erected on footings or foundations. For each upper floor, above the lowermost floor, each column 12 is generally aligned vertically with a corresponding column below, so as to constitute an upward extension of the column below.

The columns 12 may be made of poured-in-place concrete, or may be precast concrete, or may be of any other suitable construction. In the case of poured concrete columns, it is preferred to employ high early strength concrete which will cure rapidly to develop adequate strength in a short time, such as a day or two.

Figure 2:
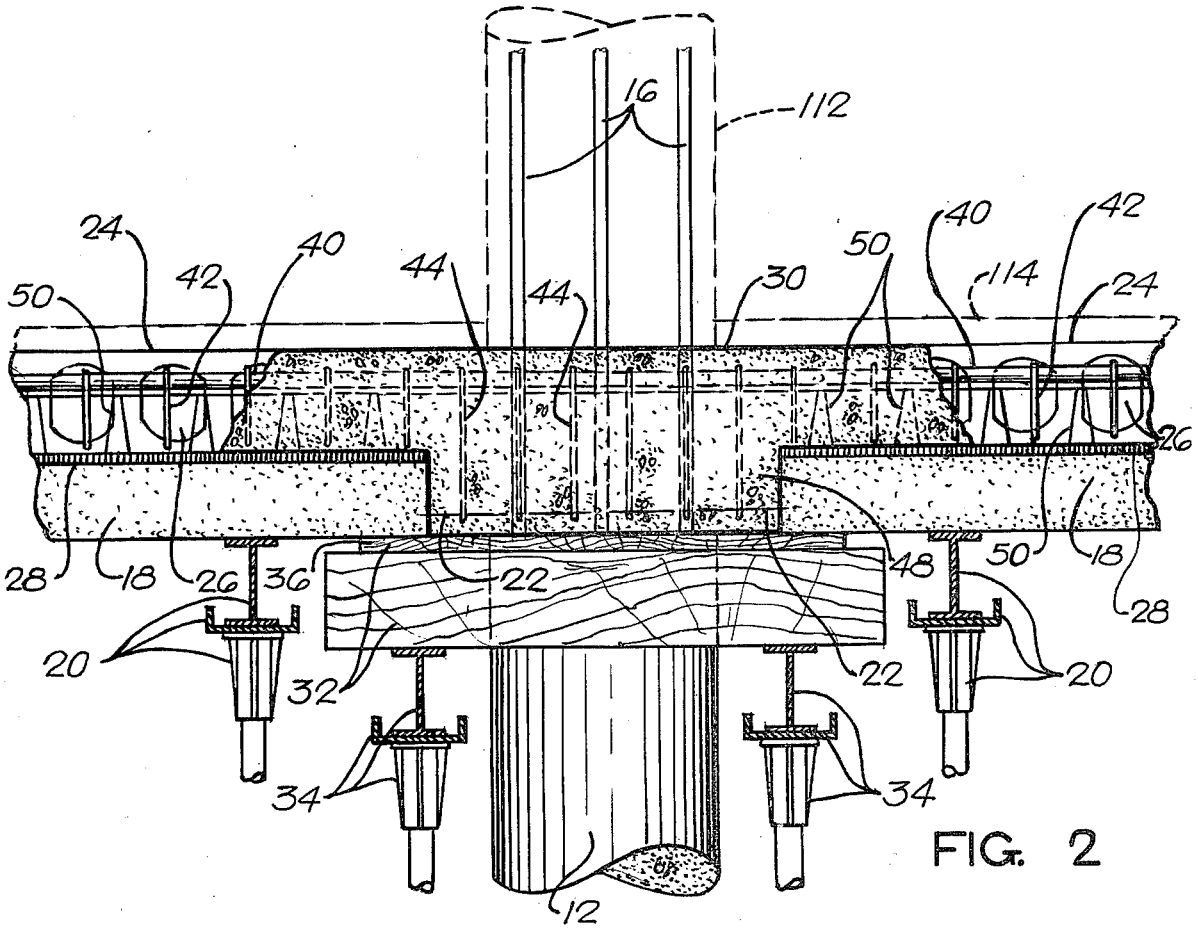
FIG. 2 is a fragmentary enlarged section, taken generally along the line 2—2 in FIG. 1, at a later stage of construction, to show one of the poured monolithic concrete members.
Figure 3:
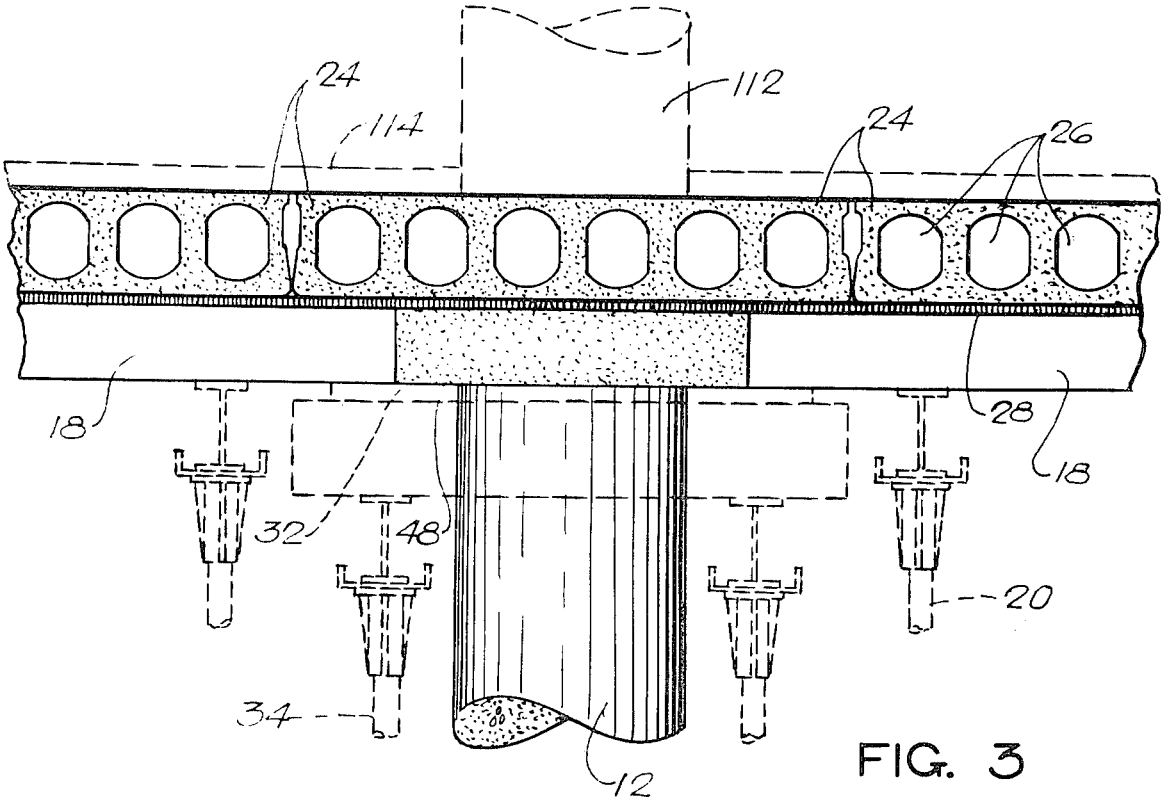
FIG. 3 is another fragmentary elevational section, taken generally along the line 3—3 in FIG. 1, transversely through the precast concrete floor slabs.

Reinforcing bars or members 16 are generally embedded in the columns 12. As shown in FIG. 2, the reinforcing bars 16 project upwardly from each column 12. The upwardly projecting bars 16 are adapted to be embedded in the column above, for the next floor.

When the columns 12 have been erected, precast reinforced concrete beams 18 are placed upon temporary supports 20, which may be in the form of scaffolding or the like. The beams 18 are placed along the rows 14, in the spaces between the columns 12. However, the beams 18 are not supported upon the columns 12, but rather are placed on the temporary supports 20. The beams 18 are comparable in length to the spacing distance between the columns 12, but are slightly shorter than such distance so that the beams 18 do not overlap the upper ends of the columns 12. This arrangement has the advantage that the spacing between the columns 12 and the length of the precast 18 does not have to be held to close tolerances.

The precast concrete beams 18 preferably contain reinforcing members made of steel or the like. The illustrated beams 18 are of the prestressed type, in which some of the reinforcing members are in the form of longitudinal prestressing strands or tension members 22 having portions projecting out of the ends of the beams 18.

As to the lowermost floor of the building, the temporary supports 20 are placed on footings or foundations. As to upper floors, above the lowermost floor, the temporary supports 20 are placed on the previously completed floor, below the floor under construction.

Figure 4:
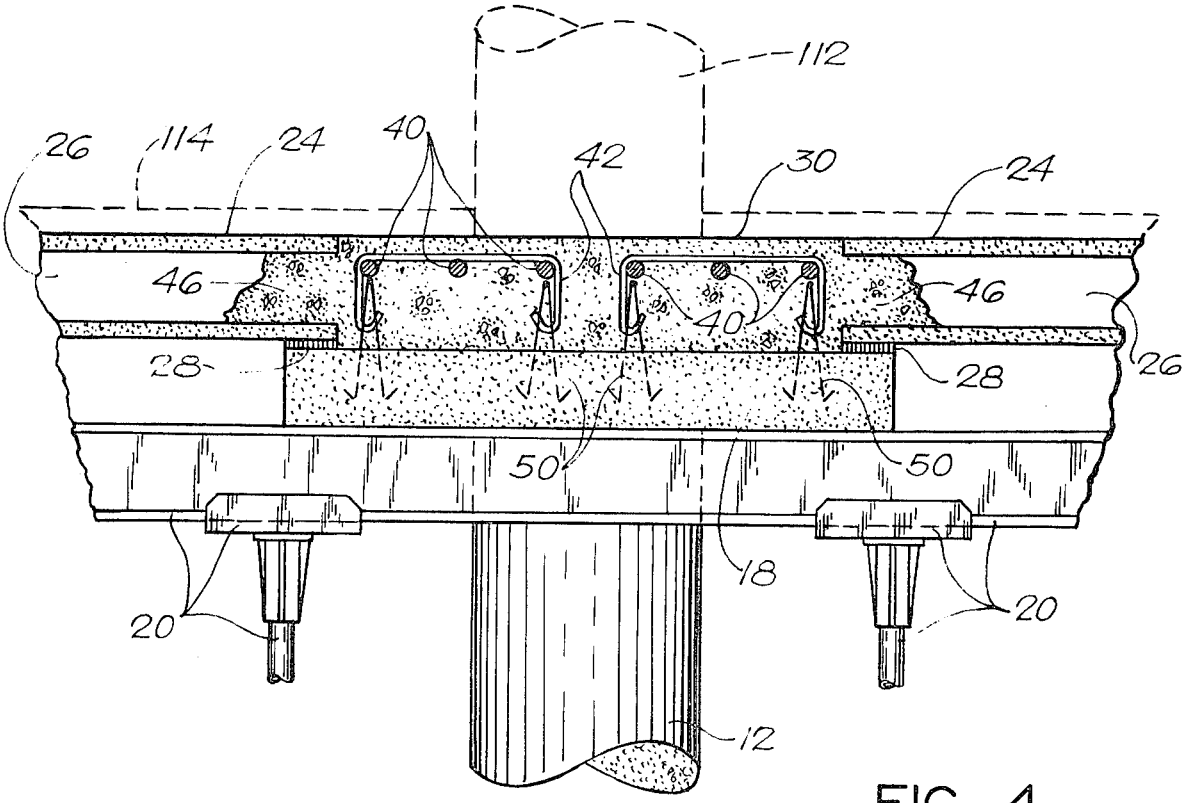
FIG. 4 is another fragmentary enlarged elevational section, taken generally along the line 4—4 in FIG. 1, taken transversely through one of the precast concrete beams and the corresponding poured monolithic concrete member.
Figure 5:
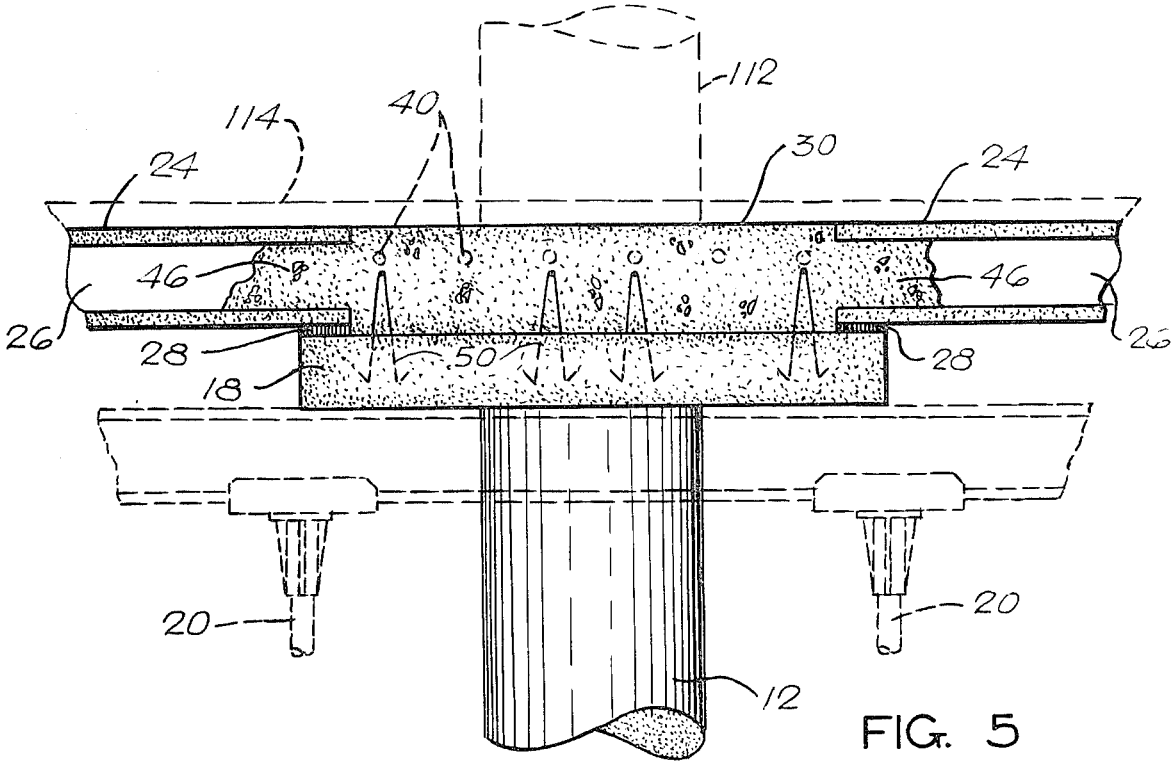
FIG. 5 is another fragmentary enlarged elevational section, taken generally along the line 5—5 in FIG. 1, and indicating the removal of the forms and temporary supports.

When the precast beams 18 have been placed on the temporary supports 20, precast reinforced concrete floor slabs 24 are placed between the precast beams 18 of adjacent rows 14, with the floor slabs 24 spanning the spaces between the precast beams 18. As shown, the floor slabs 24 are placed edge-to-edge, to form the support for a continuous floor. The floor slabs 24 extend perpendicular to the precast beams 18, with ends portions of the floor slabs 24 partially overlapping and supported upon the beams 18, as shown in FIGS. 1 and 4.

The floor slabs 24 may be made of lightweight reinforced concrete and may be of the hollow core type, having longitudinal hollow core openings 26. Bearing pads 28 may be provided between the concrete floor slabs 24 and the concrete beams 18. The bearing pads 28 may be made of thin fibrous material and may be glued to the concrete floor slabs 24.

Poured-in-place reinforced concrete members 30 are employed to unite the columns 12, the precast concrete beams 18 and the precast concrete floor slabs 24. The poured concrete members 30 are poured into the spaces bounded by the upper sides of the precast beams 18, the upper ends of the columns 12, and the ends of the precast floor slabs 24 and the beams 18.

Figure 6:
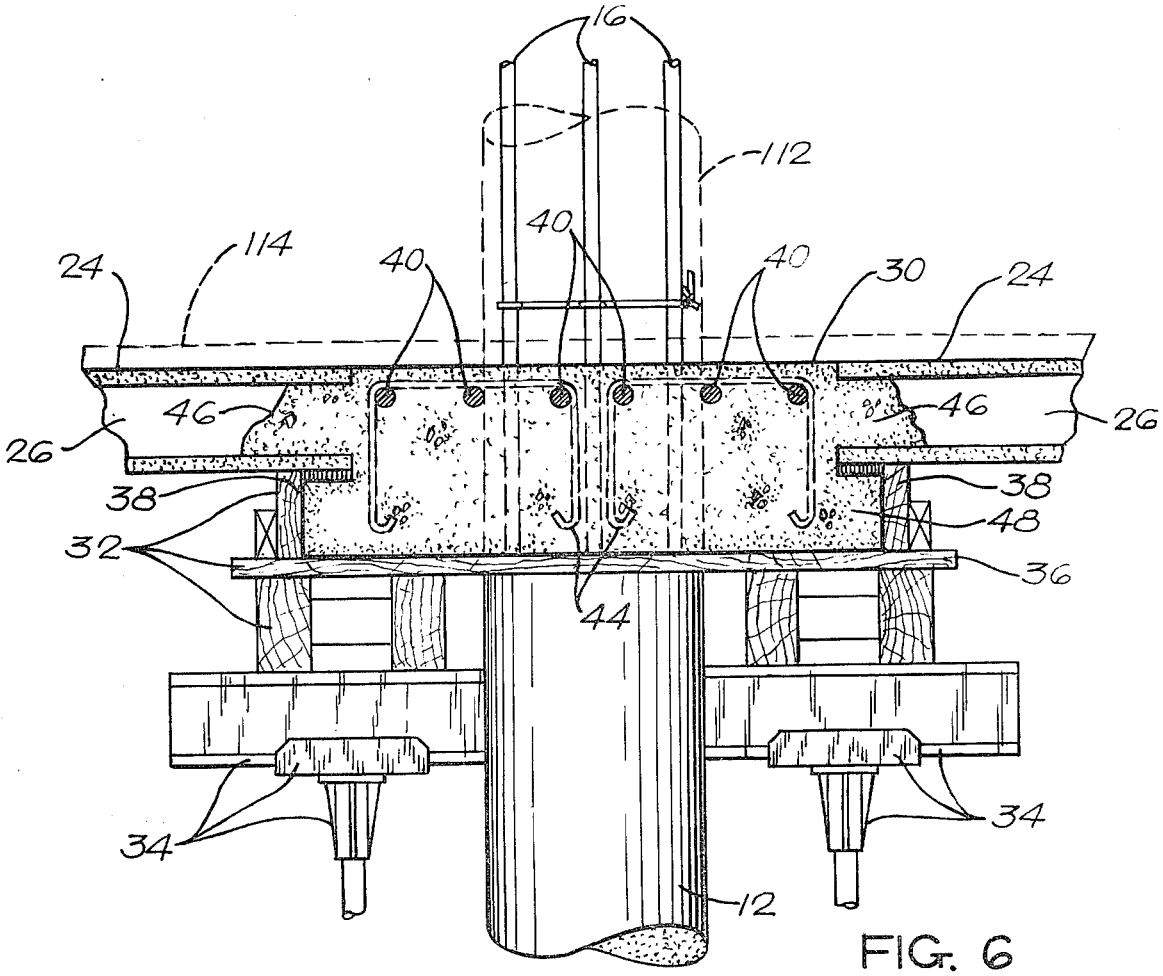
FIG. 6 is another fragmentary enlarged elevational section, taken generally along the line 6—6 in FIG. 1, with the temporary forms still in place.

In preparation for the pouring of the poured concrete members 30, temporary forms 32 are provided around the upper end portions of the columns 12, to afford bulkheads for retaining the poured concrete in the spaces between the upper ends of the columns 12, the ends of the precast beams 18, and the ends of the adjacent floor slabs 24. Such forms 32 may be placed upon additional scaffolding or other temporary supports 34. The temporary forms 32 include bottom boards 36, placed around the upper ends of the columns 12 and against the lower sides of the precast concrete beams 18, and sideboards 38, placed between the bottom boards 36 and the lower sides of the adjacent floor slabs 24, as shown in FIGS. 2 and 6.

Reinforcing members 40 are embedded in the monolithic poured concrete members 30 to provide flexural strength. The reinforcing members 40 may be in the form of longitudinal reinforcing bars adapted to be embedded in the upper portion of each poured concrete member 30. Vertical reinforcing members in the form of stirrups 42 and 44 may also be provided, as shown in FIGS. 2, 4 and 6.

In preparation for the pouring of the monolithic concrete members 30, the reinforcing members 40, 42 and 44 are placed in the spaces bounded by the upper ends of the columns 12, the upper sides and ends of the precast concrete beams 18, the ends of the floor slabs 24, and the retaining boards 36 and 38 of the temporary forms 32. The monolithic concrete members 30 are then poured along the entire length of the rows 14. Preferably, the concrete is poured so that its upper surface is level with the upper sides of the precast concrete floor slabs 24. Small portions of the wet concrete flow short distances into the hollow core spaces 26 in the floor slabs 24. When the concrete hardens, such portions become projections or keys 46 which assist in solidly uniting the floor slabs 24 with the poured concrete members 30.

In the vicinity of each of the columns 12, a portion of the wet concrete flows downwardly into the space bounded by the form boards 36 and 38, the upper end of the column 12, the ends of the precast concrete beams 18, and the end portions of the adjacent floor slabs 24. When the concrete hardens, such portion forms a downward projection or key 48 on the poured concrete member 30. Such projection or key 48 is in direct bearing engagement with the upper end of the column 12. The reinforcing bars 16, which project upwardly from the column 12, are embedded in the projection or key 48, and also in the overlying portion of the concrete member 30. The reinforcing members or strands 22, projecting from the ends of the precast beams 18, are also embedded in such projection or key 48. It will be seen from FIG. 6 that such projection or key 48 extends under the end portions of the adjacent floor slabs 24, so that such end portions are supported by such key 48.

The projections or keys 46 and 48 contribute to the manner in which the monolithic poured concrete member 30 unites the columns 12, the precast concrete beams 18 and the precast concrete floor slabs 24. The ends of the precast concrete floor slabs 18 are also frictionally retained by the keys 48 on the concrete members 30. The precast concrete beams 18 are also preferably provided with additional reinforcing members in the form of vertical stirrups 50, partially embedded in the beams 18 and projecting upwardly therefrom, so as to be embedded in the monolithic poured concrete members 30, as shown in FIGS. 2 and 4.

The poured monolithic concrete members 30 are allowed to harden, whereupon the temporary forms 32 and the supports 34 can be removed. The temporary supports 20 for the precast concrete beams 18 are left in place until the poured monolithic concrete members 30 have cured to an adequate level of strength. When the concrete members 30 have cured to the desired strength, the temporary supports 20 are removed.

Each of the monolithic poured concrete members 30 and the corresponding precast concrete beams 18 constitute a composite beam structure which supports and unifies the precast concrete floor slabs 24. Such composite beam structure is supported by the columns 12.

As soon as the poured monolithic concrete members 30 have hardened, the construction of the next floor, above the floor just completed, may be started by erecting columns 112, aligned with the upper ends of the columns 12. The upwardly projecting reinforcing bars 16 are embedded in the lower portions of the columns 112. The use of the temporary supports 20 makes it possible to proceed with the construction of the floors above each completed floor, while the poured concrete members 30 are curing to the desired level of strength.

The building construction system or method of the present invention combines the advantages of precast concrete and poured-in-place concrete construction systems. Thus, the construction method of the present invention has the advantage of rapid erection, which is one of the principal advantages of precast concrete construction systems. The present invention also has the advantage of producing a building having a high degree of rigidity and integrity, because the precast concrete columns 12, beams 18 and floor slabs 24 are rigidly united by the monolithic poured concrete members 30. This advantage of rigidity and integrity is one of the principal advantages of poured-in-place concrete building systems. One of the disadvantages of such systems is the need for a large number of temporary supports. The present invention has the further advantage of requiring only a small number of temporary supports 20, under the precast concrete beams 18. The small number of the temporary supports reduces the cost of the supports. Moreover, the temporary supports are located only under the precast beams 18, leaving all other portions of the floor completely open, so that building construction workers can proceed with installation of electrical, plumbing and duct systems, whereby the construction of the building can proceed very rapidly.

It is highly advantageous that the precast concrete beams 18 are slightly shorter than the spacing distance between the columns 12, so that the ends of the beams 18 are short of the columns 12 and do not engage the columns, when the beams 18 are placed on the temporary supports 20. With this method of assembly, it is not necessary to maintain close tolerances in the length of the beams 18 and the spacing between the columns 12. Considerable variations in such dimensions can be tolerated.

Moreover, it is not necessary to maintain close tolerances in the length of the precast concrete floor slabs 24 and the distance between the rows 14, because the floor slabs 24 merely rest upon the precast concrete beams 18, with the ends of the slabs partially overlapping the beams 18.

With the building construction system of the present invention, considerable variations in the dimensions of the precast concrete components and in the exact locations of the columns can be accommodated by the monolithic poured concrete members, which unite the columns and the precast components into a rigid assembly having a high degree of integrity.

If desired, the floor slabs 24 may be covered with a layer 114 of concrete or any other suitable topping material. The topping layer 114 may be either structural or nonstructural. The topping layer 114 may also cover the poured concrete members 30.

The building construction system of the present invention is particularly well adapted for use with concrete columns, which may be either precast or cast in place. However, the building construction system may be employed with other types of columns. Similarly, the building construction system of the present invention is particularly well adapted for use with precast concrete beams and floor slabs. However, the building construction system may be employed with other types of beams and floor members.

I claim:

1. A building construction, comprising a plurality of columns arranged in a plurality of rows, a plurality of composite beam structures supported by said columns of each row and extending along said rows between said columns in each row, and a plurality of precast concrete floor slabs extending between said beam structures of adjacent rows and supported by said beam structures, each of said beam structures comprising a plurality of lower members in the form of longitudinally aligned precast concrete beams which are comparable but somewhat shorter in length than the distance between the successive columns in the corresponding row so that the ends of said precast beams are short of said columns and do not rest upon said columns, each of said beam structures further comprising a monolithic concrete upper member made of poured-in-place reinforced concrete extending along the entire row of columns and directly bearing on said columns in the row while filling the space between the upper ends of the columns and the ends of the precast concrete beams, said precast concrete floor slabs having end portions resting upon and partially overlapping said precast concrete beams, said monolithic concrete member engaging the upper sides of said precast concrete beams and filling the spaces between the ends of said precast concrete floor slabs and the precast concrete beams to unite said floor slabs and said beams, said monolithic concrete member having its upper surface terminating substantially flush with the upper surface of said precast concrete floor slabs, said monolithic concrete member having integral portions filling the spaces between the ends of said precast concrete beams and supported directly by said columns for uniting said columns and said precast concrete beams, said precast concrete beams including reinforcing members having portions embedded in said beams and other portions projecting upwardly out of said beams and embedded in portions of said monolithic concrete members between the ends of said precast concrete floor slabs, said precast concrete beams including longitudinal reinforcing tension members extending longitudinally therethrough and having portions extending out of the ends of said precast concrete beams and embedded in the portions of said monolithic concrete members between the ends of said precast concrete beams and above said columns, said precast concrete floor slabs having a multiplicity of hollow core openings extending longitudinally therethrough, said monolithic concrete members having portions extending partway into said hollow core openings and interlocking with said floor slabs.

2. A building construction, comprising a plurality of columns arranged in a plurality of rows, a plurality of composite beam structures supported by said columns of each row and extending along said rows between said columns in each row, and a plurality of precast concrete floor slabs extending between said beam structures of adjacent rows and supported by said beam structures, each of said beam structures comprising a plurality of lower members in the form of longitudinally aligned precast concrete beams which are comparable but somewhat shorter in length than the distance between the successive columns in the corresponding row so that the ends of said precast beams are short of said columns and do not rest upon said columns, each of said beam structures further comprising a monolithic concrete upper member made of poured-in-place reinforced concrete extending along the entire row of columns and directly bearing on said columns in the row while filling the space between the upper ends of the columns and the ends of the precast concrete beams, said precast concrete floor slabs having end portions resting upon and partially overlapping said precast concrete beams, said monolithic concrete member engaging the upper sides of said precast concrete beams and filling the spaces between the ends of said precast concrete floor slabs and the precast concrete beams to unite said floor slabs and said beams, said monolithic concrete member having its upper surface terminating substantially flush with the upper surface of said precast concrete floor slabs, said monolithic concrete member having integral portions filling the spaces between the ends of said precast concrete beams and supported directly by said columns for uniting said columns and said precast concrete beams, said precast concrete beams including reinforcing members having portions embedded in said beams and other portions projecting upwardly out of said beams and embedded in portions of said monolithic concrete members between the ends of said precast concrete floor slabs, said precast concrete beams including longitudinal reinforcing tension members extending longitudinally therethrough and having portions extending out of the ends of said precast concrete beams and embedded in the portions of said monolithic concrete members between the ends of said precast concrete beams and above said columns, said precast concrete floor slabs having a multiplicity of hollow core openings extending longitudinally therethrough, said monolithic concrete members having portions extending partway into said hollow core openings and interlocking with said floor slabs, said columns comprising reinforced concrete with longitudinal reinforcing bars extending upwardly from the upper ends of said columns and embedded in said monolithic concrete members, said bars having upper portions projecting above said monolithic concrete members, said building construction including poured-in-place columns aligned above said first mentioned columns and poured-in-place upon the upper surfaces of said monolithic concrete members with said upper portions of said reinforcing bars embedded in said poured-in-place columns.

* * * * *